US006708016B2

(12) United States Patent
Fukuhata et al.

(10) Patent No.: US 6,708,016 B2
(45) Date of Patent: Mar. 16, 2004

(54) DEVELOPING DEVICE COMPRISING A REGULATION MEMBER HAVING AT LEAST ONE BENT PART

(75) Inventors: Yoshihiro Fukuhata, Takarazuka (JP); Akihiro Kawasaki, Itami (JP); Hiroaki Umemoto, Amagasaki (JP); Koji Uno, Kobe (JP); Eiji Gyotoku, Itami (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/145,691

(22) Filed: May 16, 2002

(65) Prior Publication Data

US 2002/0172534 A1 Nov. 21, 2002

(30) Foreign Application Priority Data

May 21, 2001 (JP) ..... 2001-151202

(51) Int. Cl.[7] ..... G03G 15/08
(52) U.S. Cl. ..... 399/284; 399/103
(58) Field of Search ..... 399/284, 274, 399/103, 105; 118/261

(56) References Cited

U.S. PATENT DOCUMENTS

| | | | | |
|---|---|---|---|---|
| 4,566,402 A | | 1/1986 | Shimazaki | 399/284 |
| 4,920,916 A | | 5/1990 | Mizuno et al. | 399/284 |
| 5,338,895 A | | 8/1994 | Ikegawa et al. | 399/280 |
| 5,365,318 A | | 11/1994 | Hiraoka et al. | 399/44 |
| 5,587,551 A | | 12/1996 | Ikegawa et al. | 399/284 |
| 5,937,253 A | | 8/1999 | Shimazaki et al. | 399/284 |
| 6,021,298 A | * | 2/2000 | Liu et al. | 399/284 |
| 6,021,299 A | * | 2/2000 | Hansburg et al. | 399/284 |
| 6,144,829 A | | 11/2000 | Miyasaka et al. | 399/281 |
| 6,343,201 B1 | | 1/2002 | Wada et al. | 399/281 |

FOREIGN PATENT DOCUMENTS

| | | | |
|---|---|---|---|
| JP | 05-158345 | * | 6/1993 |
| JP | 11-316499 | | 11/1999 |

* cited by examiner

*Primary Examiner*—Sophia S. Chen
(74) *Attorney, Agent, or Firm*—Morrison & Foerster LLP

(57) ABSTRACT

The present invention relates to a developing device for developing images formed on an image carrier. The device is capable of regulating toner amount such that the amount of toner conveyed by the toner control to the developing area is reduced, as well a appropriately changing the carrier.

16 Claims, 4 Drawing Sheets

DEVELOPING DEVICE COMPRISING A REGULATION MEMBER HAVING AT LEAST ONE BENT PART

RELATED APPLICATIONS

The present invention is based on Japanese Patent Application No. 2001-151,202, the contents of which are incorporated by reference.

BACKGROUND OF THE INVENTION

1. Field of the Invention

The present invention relates to a developing device used in an image forming apparatus such as a copying machine or printer.

2. Description of the Related Art

Developing devices based on the two-component developing method that uses toner and a carrier as the developer and developing devices based on the single-component developing method that does not use a carrier and use only toner are known in the conventional art as developing devices used in image forming apparatuses such as copying machines and printers. As developing devices based on the single-component developing method, those based on the magnetic single-component developing method that includes a magnetic member inside the toner carrier and those based on the non-magnetic single-component developing method that uses a toner carrier that does not include a magnetic member are known.

An example of the developing device using the single-component developing method is shown in FIG. 1. In this developing device, the toner (t) housed in the casing 1 of the system main unit is forwarded by a toner forwarding member 2 to a roller-like toner supply member 3. The toner (t) is supplied to a roller-like toner carrier 4 via the rotation of the toner supply member 3, and the toner carrier 4 further conveys the supplied toner (t) via the rotation thereof. A plate-like regulating member 5 is mounted to the casing 1 at one edge thereof, such that the other edge of the regulating member 5 is in pressure contact with the surface of the toner carrier 4. This regulating member 5 regulates the amount of the toner (t) that is conveyed by the toner carrier 4 and at the same time charges the toner (t). The toner (t) that is regulated and charged in this way is guided by the toner carrier 4 to the developing area in which the toner carrier 4 faces the image carrier 6, whereupon developing takes place.

However, because only a single regulating member 5 is in pressure contact with the surface of the toner carrier 4, problems exist, such as the fact that it is difficult to appropriately regulate the amount of the toner (t) conveyed by the toner carrier 4 and to appropriately charge the toner (t). In particular, the problem exists that it is difficult to reduce the amount of the toner (t) that is conveyed by the toner carrier 4 to the developing area and to charge the toner (t) appropriately.

Systems have been proposed in recent years to address these problems, such as the system that includes two regulating members located inside the casing of the system main unit that are in pressure contact with the surface of the toner carrier, such that the amount of the toner held on the surface of the toner carrier and conveyed is regulated and the toner (t) is charged by the two regulating members, as disclosed by U.S. Pat. No. 6,343,201, and a system in which one edge of a regulating member is mounted to the system main unit and the other edge area of the regulating member is bent such that the regulating member is in contact with the surface of the toner carrier at two or more contact points, and the amount of the toner held on the surface of the toner carrier is regulated and the toner (t) is charged at each contact area, as disclosed by Japanese Laid-Open Patent Application H11-316499.

However, the problems exist that (1) it is troublesome to install two regulating members inside the system main unit such that they are in pressure contact with the surface of the toner carrier in the manner disclosed in U.S. Pat. No. 6,343,201, and (2) construction of such a system is more costly due to the increased number of components. In addition, where the regulating member is attached to the system main unit at one edge thereof while the other edge area thereof is bent such that the regulating member is in contact with the surface of the toner carrier at two or more contact points, as disclosed by Japanese Laid-Open Patent Application H11-316499, the problem exists that one edge of the regulating member must be mounted to the system main unit using mounting members such as screws, which is inconvenient.

SUMMARY OF THE INVENTION

An object of the present invention is to provide a developing device capable of regulating the toner amount such that the amount of toner conveyed by the toner carrier to the developing area is reduced, as well as of appropriately charging the toner.

Another object of the present invention is to provide a developing device that comprises a reduced number of components and can accordingly be manufactured more easily and at a lower cost.

Still another object of the present invention is to provide a developing device that does not entail the inconvenient task of mounting the regulating member to the system main unit using mounting members such as screws.

The present invention relates to a developing device for developing images formed on an image carrier comprising: a rotatably mounted roller-like toner carrier for holding a toner on the surface thereof; a plate-like regulating member for regulating an amount of the toner held on the toner carrier, the regulating member having at least one bent part, a first regulating part that is located such that it is in contact with the toner carrier and a second regulating part that is located such that it is in contact with the toner carrier at downstream side of the first regulating part with respect to the surface-moving direction of the toner carrier; and a casing for accommodating the toner, the toner carrier and the regulating member; wherein the regulating member is positioned between the toner carrier and the casing.

DESCRIPTION OF THE PREFERRED EMBODIMENTS

The developing device pertaining to an embodiment of the present invention is described below in specific terms with reference to the accompanying drawings.

Figure 1:
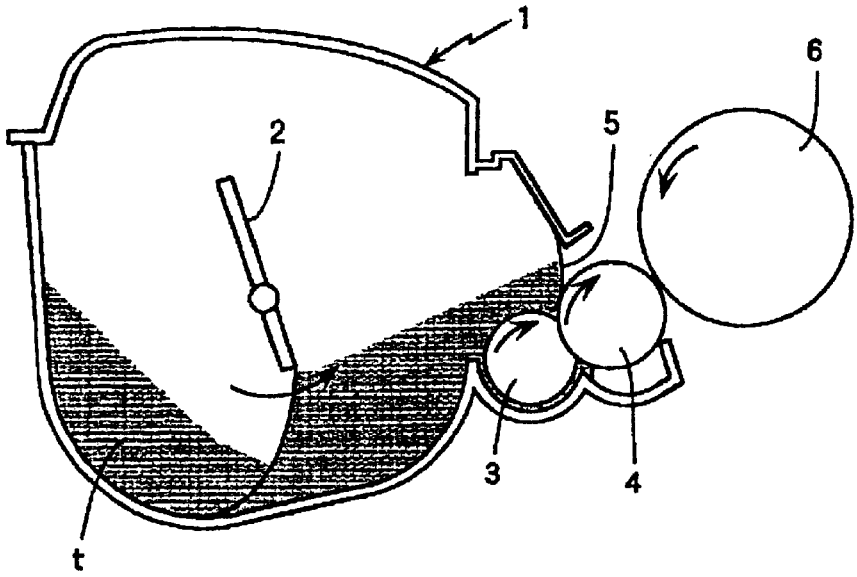
Fig. 1 PRIOR ART
FIG. 1 is a basic explanatory drawing of a conventional developing device.
Figure 2:
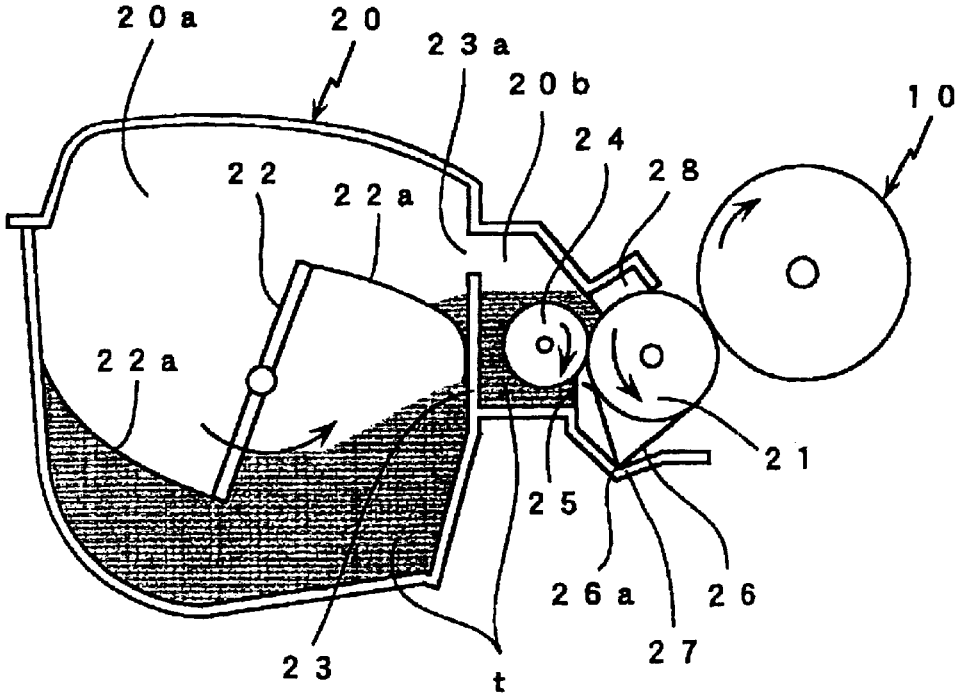
FIG. 2 is a basic explanatory drawing of a developing device pertaining to one embodiment of the present invention.

In the developing device pertaining to this embodiment, as shown in FIG. 2, a toner carrier 21 faces the image carrier 10 that rotates, and the toner carrier 21 is caused to rotate in the opposite direction from the direction of rotation of the image carrier 10 such that the toner carrier 21 and the image carrier 10 are respectively caused to rotate upward in the developing area in which they face each other.

In addition, in this developing device, toner (t) is housed in a housing unit 20*a* of the casing 20 of the system main unit, and a toner forwarding member 22 having blade members 22*a* is rotatably mounted in the housing unit 20*a*.

Through the rotation of this toner forwarding member 22, the blade members 22*a* supply the toner (t) housed in the housing unit 20*a* to a toner supply unit 20*b* via an opening 23*a*. The toner supply unit 20*b* is separated from the housing unit 20*a* by a partition member 23.

Furthermore, a roller-like toner supply member 24 is located in the toner supply unit 20*b* such that it is in contact with the toner carrier 21. Through the rotation of the toner supply member 24 in the direction opposite from the direction of rotation of the toner carrier 21, the toner (t) in the toner supply unit 20*b* is supplied to the toner carrier 21 by the toner supply member 24. The toner (t) that is not supplied to the toner carrier 21 and remains on the toner supply member 24 is scraped off from the toner supply member 24 by a scraper 25.

In this developing device, a regulating member 26, which is bent into a letter V configuration via a bent part 26*a*, which extends along the axis of the toner carrier 21, is located below the toner carrier 21. All edge areas of the V-shaped regulating member 26 that resides in the area between the scraper 25 and the image carrier 10 are in contact with the surface of the toner carrier 21. The bent part 26*a* of the regulating member 26 is held in a groove-like engaging unit 27 that is located in the casing 20 of the system main unit at a position below the toner carrier 21. The regulating member 26 is held sandwiched between the casing 20 of the system main unit and the toner carrier 21.

Because the bent part 26*a* is held in the groove-like engaging unit 27 and the regulating member 26 is sandwiched between the casing 20 of the system main unit and the toner carrier 21 in this way, the regulating member 26 is prevented from being dislodged when the toner (t) held on the toner carrier 21 is regulated and charged by the regulating member 26 that is in contact with the surface of the rotating toner carrier 21, even if the regulating member 26 is not fixed to the casing 20 of the system main unit using screws or other means, as in the conventional apparatus. Incidentally, the part from the bent part 26*a* to the free edge that is located upstream in terms of the direction of rotation of the toner carrier will be termed the first regulating part, and the part from the bent part 26*a* to the free edge that is located downstream in terms of the direction of rotation of the toner carrier will be termed the second regulating part.

The edge of the first regulating part that is in contact with the surface of the toner carrier 21 on the side of the scraper 25 is bent, and the toner (t) held on the toner carrier 21 is regulated and charged by the first regulating part. Subsequently, the toner (t) held on the toner carrier 21 is further regulated and charged by the second regulating part that is in contact with the surface of the toner carrier 21 on the side of the image carrier 10.

In this way, the toner (t) that is held onto and conveyed by the surface of the toner carrier 21 is simultaneously regulated and charged by each regulating part of the regulating member 26, such that the amount of the toner (t) conveyed by the toner carrier 21 to the developing area is easily reduced to a small amount and the toner (t) is appropriately charged. In addition, if the edge of the first regulating part of the regulating member 26 is bent and then placed into contact with the surface of the toner carrier 21, the pressure exerted by the first regulating part that is in contact with the surface of the toner carrier 21 becomes constant, and the toner (t) supplied to the toner carrier 21 can be uniformly regulated and charged.

The toner (t) that is regulated and charged by the regulating member 26 is conveyed by the toner carrier 21 to the developing area in which the toner carrier 21 faces the image carrier 10. In this developing area, the toner carrier 21 and the image carrier 10 are respectively caused to rotate upward, such that the toner (t) is supplied to the electrostatic latent image areas formed on the image carrier 10 from the toner carrier 21 and developing is preformed.

Figure 3:
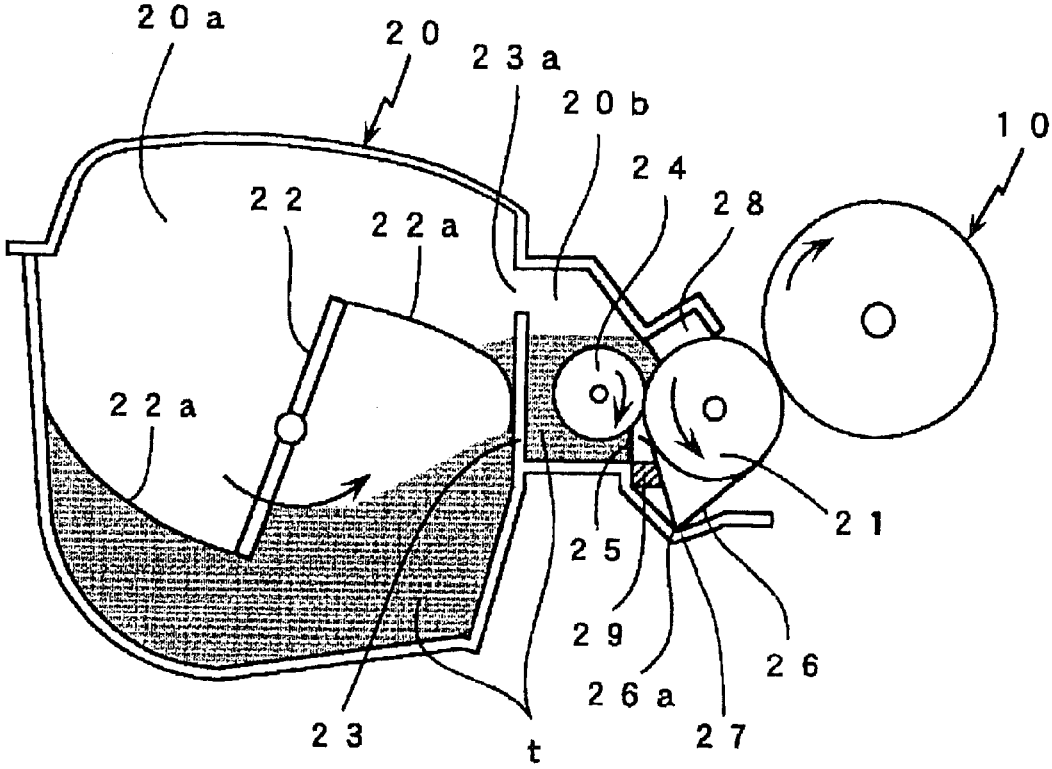
FIG. 3 is a basic explanatory drawing showing one example of a developing device including a sealing member that prevents toner from entering.

The toner (t) that remains on the toner carrier 21 after the electrostatic latent image formed on the image carrier 10 is developed is separated therefrom by the sealing member 28 located in the casing 20 of the system main unit, and returns into the toner supply unit 20*b*. New toner (t) is thereafter supplied by the toner supply member 24 to the toner carrier 21.

Where the toner (t) that is not supplied to the toner carrier 21 and remains on the toner supply member 24 is scraped off by the scraper 25 from the toner supply member 24 or the toner (t) held onto the toner carrier 21 is regulated by the first regulating part of the regulating member 26 and separated from the toner carrier 21, toner (t) gradually accumulates on the back side of the regulating member 26, i.e., the opposite side from the side of the first regulating part that is in connect with the toner carrier, which may cause the contact pressure of the first regulating part of the regulating member 26 to the toner carrier 21 to gradually increase, resulting in the loss of appropriate regulation by the regulating member 26. Therefore, as shown in FIG. 3, it is preferred that a sealing member 29 that prevents the entrance of toner (t) be located opposite from the toner carrier 21 in the vicinity of the first regulating part of the regulating member 26 that is in contact with the surface of the toner carrier 21. If this sealing member 29 is formed from an elastic material, the vibration of the regulating member 26 is reduced by the sealing member 29.

If the engaging unit 27 in which the bent part 26*a* of the regulating member 26 is held is formed from an elastic material, the vibration of the regulating member 26 is reduced by the engaging unit 27. It is also possible to make this engaging unit 27 detachable such that it can be replaced where appropriate.

Figure 4:
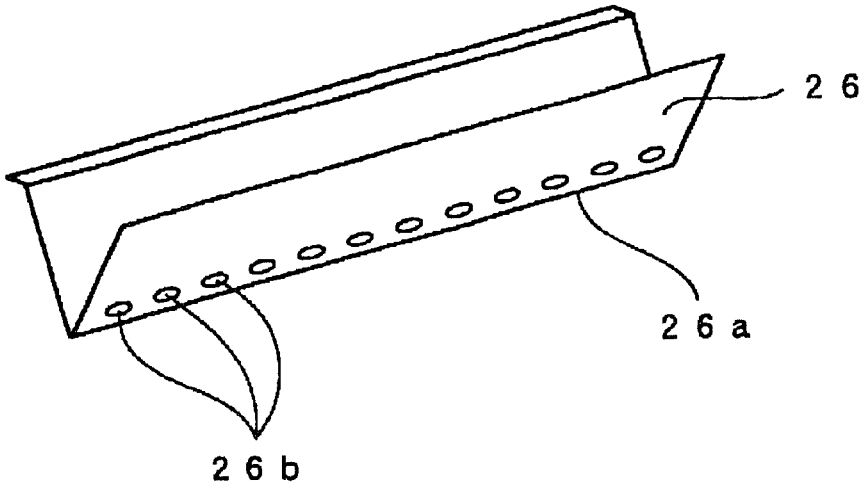
FIG. 4 is perspective view showing one example of a regulating member near the bent part in which are located ejection holes through which the accumulated toner is ejected.

In addition, if toner (t) separates from the surface of the toner carrier 21 in the area between the first regulating part and the second regulating part and accumulates in the bent part 26*a* of the regulating member 26, the contact pressure applied by the second regulating part may gradually decrease due to the toner (t), resulting in the loss of appropriate regulation by the regulating member 26. Therefore, as shown in FIG. 4, ejection holes 26*b* through which to eject the toner (t) accumulated in the bent part 26*a* may be created near the bent part 26*a* of the regulating member 26.

Figure 5:
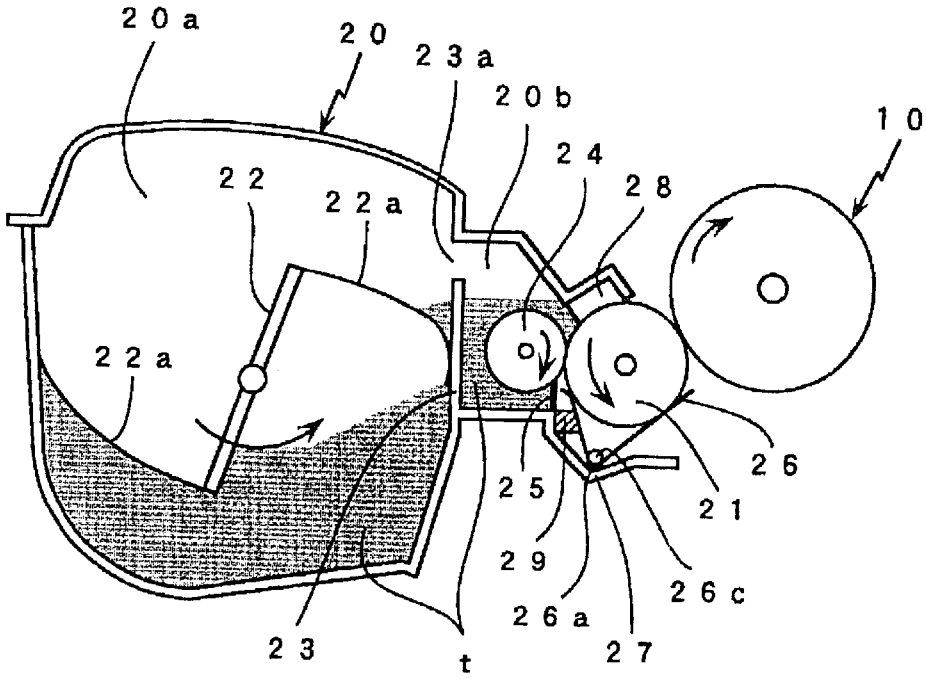
FIG. 5 is a basic explanatory drawing showing one example of a developing device that includes a rod member at the bent part of the regulating member such that the bent part of the regulating member is held in the engaging unit of the system main unit via the rod member.

Moreover, as shown in FIG. 5, it is also acceptable if a rod member 26*c* is located in the bent part 26*a* of the regulating member 26 such that the bent part 26*a* of the regulating member 26 is held in the engaging unit 27 by this rod member 26*c*. In this way, the regulating member 26 is further prevented from becoming dislodged. Furthermore, if a bias voltage that charges the toner (t) is impressed to the regulating member 26 via the rod member 26*c*, the toner (t) becomes more appropriately charged.

Figure 6:
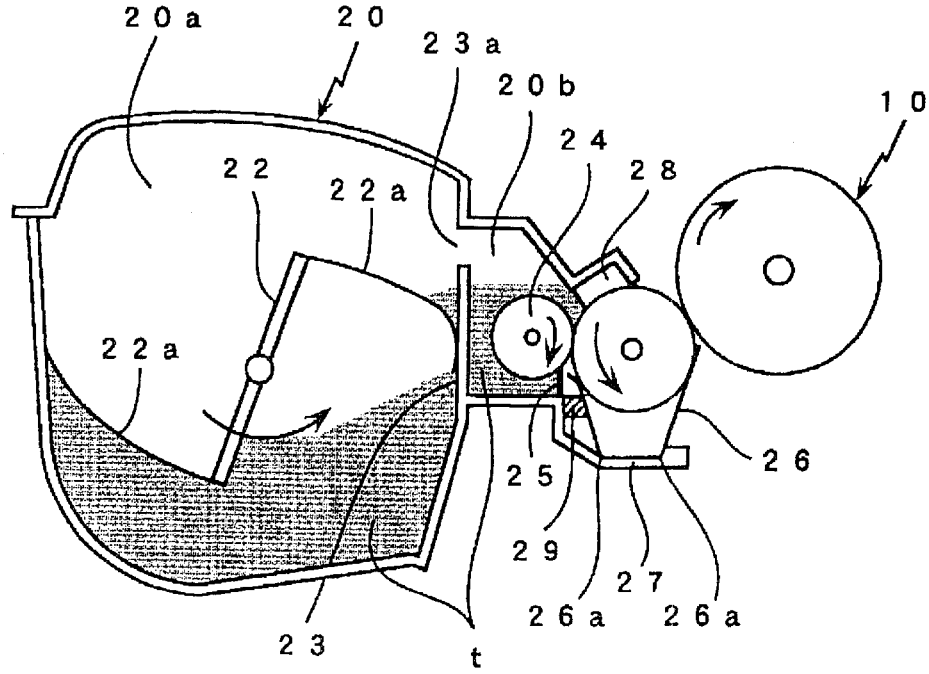
FIG. 6 is a basic explanatory drawing showing one example of a developing device in which a regulating member that is bent via two bent parts that extend along the axis of the toner carrier such that the regulating member has a trough configuration.

It is also acceptable if a regulating member 26 be used that is bent along two bent parts 26*a* that extend along the axis of the toner carrier 21 such that the regulating member 26 has a trough configuration, as shown in FIG. 6. Where this regulating member 26 is used as well, the regulating member 26 should be held in the engaging unit 27 located in the casing 20 of the system main unit at a position below the toner carrier 21 such that the regulating member 26 is held sandwiched between the casing 20 of the system main unit and the toner carrier 21.

In the developing device pertaining to the above embodiment, as described above, the toner carrier 21 and the image carrier 10 are each caused to rotate upward in the developing area in which they face each other, and a regulating member 26 that is bent into a letter V configuration via a bent part 26*a* is held in an engaging unit 27 located in the casing 20 of the system main unit at a position below the toner carrier 21, such that the regulating member 26 is held between the casing 20 of the system main unit and the toner carrier 21.

Figure 7:
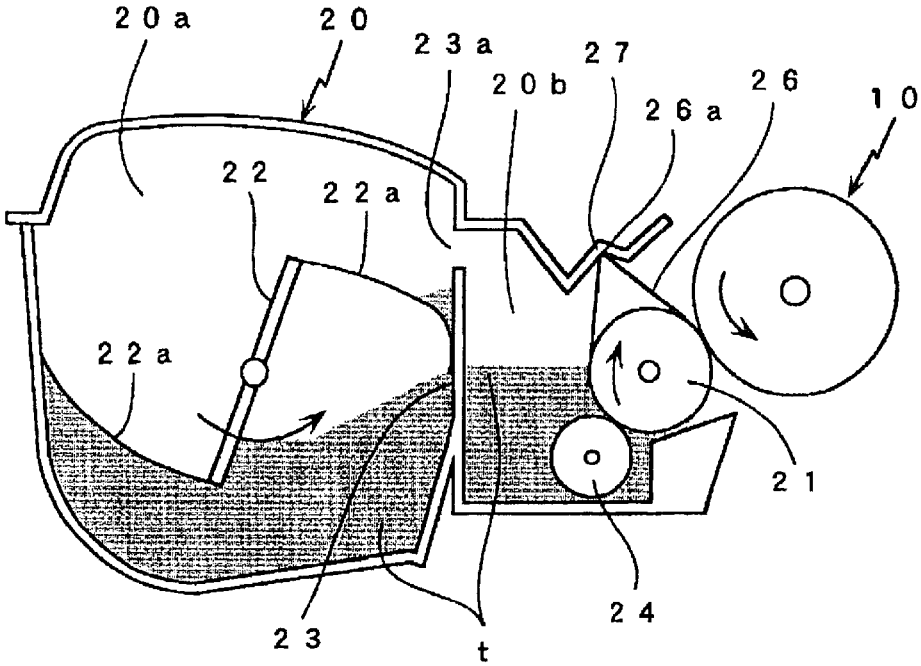
FIG. 7 is a basic explanatory drawing showing one example of a developing device in which the toner carrier and the image carrier are each caused to rotate downward in the developing area in which the toner carrier and the image carrier face each other.

However, the developing device of the present invention is not limited to the above embodiment, and other implementations are possible. For example, as shown in FIG. 7, the toner carrier 21 and the image carrier 10 may each be caused to rotate downward in the developing area in which they face each other, and the bent part 26*a* of the regulating member 26 bent into a letter V configuration may be held in a groove-like engagement unit 27 located in the casing 20 of the system main unit at a position above the area at which the toner (t) inside the toner supply unit 20*b* is supplied to the toner carrier 21 by the toner supply member 24, such that the regulating member 26 is held between the casing 20 of the system main unit and the toner carrier 21.

In the developing device of the present invention, it is preferred that a member comprising an SUS plate member having a thickness ranging from 40 to 80 $\mu$m be used as the regulating member 26, and where the regulating member 26 is bent at the bent part 26*a* in order to form it into a letter V configuration, as described above, it is preferred that the angle of the V shape range from 50 to 80 degrees.

A color image forming apparatus in which the developing device of the above embodiment is employed will now be described in detail with reference to the accompanying drawings.

Figure 8:
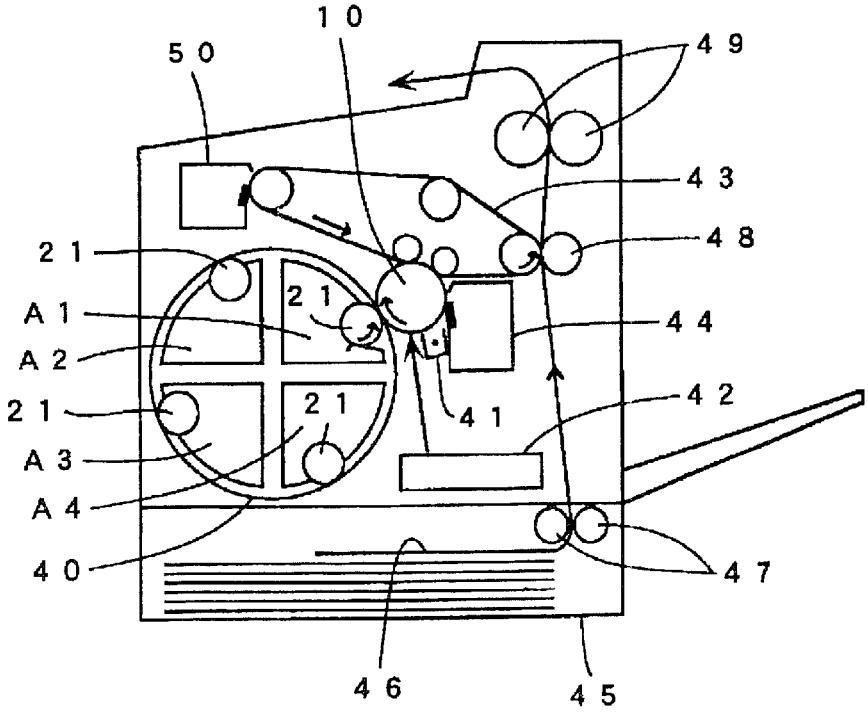
FIG. 8 is a basic explanatory drawing of a color image forming apparatus that uses four developing devices pertaining to the embodiment of the present invention and forms color images using toners of different colors, i.e., yellow, magenta, cyan and black, that are respectively housed in these four developing devices.

Here, the color image forming apparatus uses four developing devices A1 through A4 described in connection with the above embodiment, as shown in FIG. 8, and these four developing devices A1 through A4, respectively house toners of different colors, i.e., yellow, magenta, cyan and black.

These four developing devices A1 through A4 are held on a holder 40 that rotates, and the positions of each developing device A1 through A4 are changed by rotating the holder 40 such that the toner carrier 21 of each developing device A1 through A4 is sequentially guided to the position at which it faces the image carrier 10. In the developing area in which each toner carrier 21 and the image carrier 10 face each other, the toner carrier 21 and the image carrier 10 are respectively caused to rotate upward.

When forming a color image using this color image forming apparatus, for example, the toner carrier 21 in the first developing device A1, in which is housed yellow toner, is first positioned such that it faces the image carrier 10, the image carrier 10 is caused to rotate, the surface thereof is uniformly charged by a charger 41, and exposure of the charged image carrier 10 is performed by an exposure device 42 in accordance with image signals to form an electrostatic latent image on the surface of the image carrier 10.

Next, in the developing area in which the image carrier 10, on which has been formed an electrostatic latent image as described above, and the toner carrier 21 of the first developing device A1 face each other, the toner carrier 21 and the image carrier 10 are respectively caused to rotate upward, the yellow toner is supplied from the toner carrier 21 to the electrostatic latent image area formed on the image carrier 10 to form on the image carrier 10 a yellow toner image that corresponds to the electrostatic latent image.

While the yellow toner image formed on the image carrier 10 in this way is transferred to an intermediate transfer unit 43, which has a continuous belt configuration and is suspended above the image carrier 10, the yellow toner remaining on the image carrier 10 after the transfer is removed therefrom by a cleaning device 44.

The holder 40 is then caused to rotate such that the toner carrier 21 of the second developing device A2, in which magenta toner is housed, faces the image carrier 10, and a magenta toner image is formed on the surface of the image carrier 10 in the same manner as with the first developing device A1, the magenta toner image is transferred to the intermediate transfer unit 43 on which the yellow toner image was transferred, and the magenta toner remaining on the image carrier 10 after the transfer is removed therefrom by the cleaning device 44.

A cyan toner image is then formed, through the same operation, on the surface of the image carrier 10 by the third developing device A3 in which cyan toner is housed, and after this cyan toner image is transferred to the image transfer unit 43, a black toner image is formed on the surface of the image carrier 10 by the fourth developing device A4 in which black toner is housed, and this black toner image is transferred to the intermediate transfer unit 43. A multicolor toner image is thus formed via the transfer of the yellow, magenta, cyan and black toner images onto the intermediate transfer unit 43.

A recording sheet 46 is then guided by forwarding rollers 47 from a paper cassette 45 located in the bottom part of the color image forming apparatus to the area in which the intermediate transfer unit 43 and the transfer roller 48 face each other, and the multi-color toner image formed on the intermediate transfer unit 43 is transferred onto the recording sheet 46. The multi-color toner image transferred onto the recording sheet 46 is fused thereto by a fusing device 49 and the recording sheet 46 is ejected. The toner that was not transferred and remains on the intermediate transfer unit 43 is removed from the intermediate transfer unit 43 by a cleaning device 50.

Although the present invention has been fully described by way of examples, it is to be noted that various changes and modification will be apparent to those skilled in the art. Therefore, unless otherwise such changes and modifications depart from the scope of the present invention, they should be construed as being included therein.

What is claimed is:

1. A developing device for developing images formed on an image carrier comprising:

a rotatably mounted roller-like toner carrier for holding a toner on the surface thereof;

a plate-like regulating member for regulating an amount of the toner held on the toner carrier, the regulating member having at least one bent part, a first regulating part that is located such that it is in contact with the toner carrier and a second regulating part that is located such that it is in contact with the toner carrier downstreamside of the first regulating part with respect to the surface-moving direction of the toner carrier, said bent part forming a boundary between the first regulating part and the second regulating part; and a casing for accommodating the toner, the toner cater and the regulating member;

wherein the regulating member is positioned between the toner carrier and the casing.

2. The developing device of claim 1, wherein the regulating member has a thickness ranging from 40 to 80 $\mu$m.

3. The developing device of claim 1, wherein the regulating member has a V-shaped configuration.

4. The developing device of claim 1, wherein the bent part has a bent angle of between 50 and 80 degrees.

5. The developing device of claim 1, wherein the casing has an engaging part, and the bent part of the regulating member is held in the engaging part.

6. The developing device of claim 5, wherein the engaging part comprises a groove.

7. The developing device of claim 1, wherein the first regulating part has a first surface that is on the side of the toner carrier and a second surface that is on the apposite side thereof, the developing device comprising a sealing member being provided in contact with the second surface.

8. The developing device of claim 1, wherein the regulating member has a second bent part on the side of the first regulating part opposite the boundary between the first regulating part and the second regulating part.

9. The developing device of claim 1, comprising a toner supplying member for supplying the toner accommodated in the casing to the toner carrier, the toner supplying member being provided in contact with the toner carrier on the upper-stream side of the regulating member with respect to the surface-moving direction of the toner carrier.

10. A developing device for developing images formed on an image carrier comprising:

a rotatably mounted roller-like toner carrier for holding a toner on the surface thereof;

a plate-like regulating member for regulating an amount of the toner held on the toner carrier, the regulating member having at least one bent part that extends along the axis of the toner carrier, the regulating member being in contact with the toner carrier at two contact portions extending along the axis of the toner carrier, said two contact portions lying on opposite sides of the bent part from each other; and a casing for accommodating the toner, the toner carrier and the regulating member, wherein the regulating member is positioned between the toner carrier and the casing, and the regulating member has a V-shaped configuration.

11. A developing device for developing images formed on an image carrier comprising:

a rotatably mounted roller-like toner carrier for holding a toner on the surface thereof;

a plate-like regulating member for regulating an amount of the toner held on the toner carrier, the regulating member having at least one bent part that extends along the axis of the toner carrier, the regulating member being in contact with the toner carrier at two contact portions extending along the axis of the toner carrier, said two contact portions lying on opposite sides of the bent part from each other;

a casing for accommodating the toner, the toner carrier end the regulating member; and a sealing member provided in contact with a surface of the regulating member having the contact portion of the sealing member positioned on the upper-stream side with respect to the rotating direction of the toner carrier, the surface of the regulating member being the other side of the contact portion of the sealing member, wherein the regulating member is positioned between the toner carrier and the casing.

12. A developing device for developing images formed on an image carrier comprising:

a rotatably mounted roller-like toner carrier for conveying a toner held on its surface to a developing area opposite to the image carrier, the surface of the toner carrier being moved upward from below in the developing area;

a toner supplying member for supplying the toner to the toner carrier; and a plate-like regulating member for regulating an amount of toner held on the toner carrier, the regulating member being positioned on the downstream side of the toner supplying member with respect to the surface-moving direction of the toner carrier, the regulating member having at least one bent part, a first regulating part that is located such that it is in contact with the toner carrier and a second regulating part that is located such that it is in contact with the toner carrier at downstream side of the first regulating part with respect to the surface-moving direction of the toner carrier, said bent part forming a boundary between the first regulating part and the second regulating part; and a casing for accommodating the toner, the toner cater, the toner supplying member and the regulating member;

wherein the regulating member is positioned between the toner carrier and the casing.

13. The developing device of claim 12, wherein the regulating member has a thickness ranging from 40 to 80 μm, and the bent part has a bent angle of between 50 and 80 degrees.

14. The developing device of claim 12, wherein the regulating member has a V-shaped configuration.

15. The developing device of claim 12, wherein the casing has an engaging part, and the bent part of the regulating member is held in the engaging part.

16. The developing device of claim 15, wherein the engaging part comprises a groove.

* * * * *

UNITED STATES PATENT AND TRADEMARK OFFICE

CERTIFICATE OF CORRECTION

PATENT NO. : 6,708,016 B2
DATED : March 16, 2004
INVENTOR(S) : Yoshihiro Fukuhata et al.

It is certified that error appears in the above-identified patent and that said Letters Patent is hereby corrected as shown below:

Column 7,
Line 34, “cater” should read -- carrier --
Line 51, “apposite” should read -- opposite --

Signed and Sealed this

Thirteenth Day of July, 2004

JON W. DUDAS
*Acting Director of the United States Patent and Trademark Office*